US011649599B1

(12) United States Patent
Fuentes

(10) Patent No.: US 11,649,599 B1
(45) Date of Patent: May 16, 2023

(54) SNOW AND ICE EVAPORATOR

(71) Applicant: Alfredo Fuentes, Irrigon, OH (US)

(72) Inventor: Alfredo Fuentes, Irrigon, OH (US)

( * ) Notice: Subject to any disclaimer, the term of this patent is extended or adjusted under 35 U.S.C. 154(b) by 65 days.

(21) Appl. No.: 17/526,605

(22) Filed: Nov. 15, 2021

Related U.S. Application Data

(60) Provisional application No. 63/113,835, filed on Nov. 14, 2020.

(51) Int. Cl.
*E01H 5/10* (2006.01)
*E01C 19/20* (2006.01)
*E01H 5/09* (2006.01)

(52) U.S. Cl.
CPC ..... *E01H 5/104* (2013.01); *E01C 19/203* (2013.01); *E01H 5/098* (2013.01)

(58) Field of Classification Search
CPC ..... E01H 5/098; E01H 5/10; E01H 5/104
See application file for complete search history.

(56) References Cited

U.S. PATENT DOCUMENTS

| | | | | |
|---|---|---|---|---|
| 3,298,290 | A | 1/1967 | Du Fresne | |
| 5,003,157 | A | 3/1991 | Hargrove | |
| 5,854,470 | A | 12/1998 | Silva | |
| 6,051,811 | A | 4/2000 | Hardison | |
| 6,184,496 | B1 | 2/2001 | Pearce | |
| 6,987,928 | B2 | 1/2006 | Shields | |
| 7,034,257 | B2 | 4/2006 | Petrenko | |
| 8,381,420 | B1 * | 2/2013 | Hipple | E01C 19/203 239/650 |
| 10,000,901 | B1 * | 6/2018 | Gallo | E01H 5/02 |
| 10,208,442 | B2 * | 2/2019 | Mast | E01H 5/045 |
| 11,214,936 | B2 * | 1/2022 | Lehman | A01B 59/062 |
| 11,236,479 | B2 * | 2/2022 | Legnaioli | E01H 5/102 |
| 2005/0158503 | A1 | 7/2005 | O'Connor | |
| 2009/0282707 | A1 * | 11/2009 | Shenouda | E01H 5/106 37/227 |
| 2016/0201272 | A1 | 7/2016 | Perkins | |
| 2017/0335523 | A1 | 11/2017 | Moussa | |
| 2018/0291578 | A1 | 10/2018 | Webster et al. | |

FOREIGN PATENT DOCUMENTS

| | | | | |
|---|---|---|---|---|
| DE | 102011113606 | A1 * | 3/2013 | E01H 5/061 |

* cited by examiner

*Primary Examiner* — Gary S Hartmann
(74) *Attorney, Agent, or Firm* — Sandy Lipkin

(57) ABSTRACT

A snow and ice evaporating device that is an untethered device easily usable by an individual. The device has elements that resemble a traditional snow blower as well as a lawn mower, but that includes a salt hopper and a propane tank. The snow blower end operates much like a traditional snow blower with augers that break up snow and ice that are then expelled through a blower end. On the top of the device is a propane tank that provides flames to the bottom of the device, protected by a shroud that heat the surface being treated to melt both ice and snow. A salt hopper is situated on the back of the device which provides a means for applying salt to the treated surface to prevent refreezing. All portions of the device are easily controlled by and extended handle that the user uses to control these functions. The extended handle operates much like a lawn mower in that it allows the user to easily push the device which rolls on wheels and includes a kill switch to turn off the device in an emergency situation.

7 Claims, 7 Drawing Sheets

SNOW AND ICE EVAPORATOR

REFERENCE TO PRIOR APPLICATION

This application claims priority of the provisional patent application 63/113,835, filed Nov. 14, 2020 entitled SNOW AND ICE EVAPORATOR by Alfredo Fuentes.

BACKGROUND OF THE INVENTION

Field of the Invention

The field of this invention relates generally to the field of machines to clear ice and snow and more particularly toward a single device that can be used as a household item to clear driveways of snow and ice.

Description of the Prior Art

In cold climates where snow and ice fall to the ground, major inconvenience is the result for users of cars and other vehicles that need to drive over that ground. Many devices that are used to clear snow and ice are cumbersome, large and expensive. This makes these prior art devices impractical for small scale use.

It is the object of the instant invention to provide for a device that is reasonably storable and easy to use by a user to use latent heat to remove snow and ice from driveways and sidewalks to create a clear path for walking and/or driving.

SUMMARY OF THE INVENTION

The basic embodiment of the present invention teaches a snow and ice evaporator comprising: a base; wheels attached to said base; a handle extending upward from said base; an engine housed in a compartment below said base; a propane tank compartment on said base; an array of torches under said base in communication with a propane tank housed in said propane tank compartment; a snow blower attached to a front of said base, said snow blower further comprising a skid plate, augers and an ejection chute for snow and ice; a salt hopper attached to a back end of said base, said salt hopper allowing for the expulsion of salt therefrom onto a surface being treated below said salt hopper; controllers on said extended handle to control said snow blower, said salt hopper and any flames from said propane tank, said controllers being in wired communication with said snow blower, said salt hopper and said array of torches.

The above embodiment can be further modified by defining that said engine is gas operated.

The above embodiment can be further modified by defining that said engine is electrically powered.

The above embodiment can be further modified by defining that said array of torches is covered by a protective shroud.

The above embodiment can be further modified by defining that salt hopper further comprises an open and closeable lid to allow for the placement of salt therein.

The above embodiment can be further modified by defining that said salt hopper further comprises a slot on a bottom of said salt hopper controlled by a lever to allow for the expulsion of salt therefrom.

The above embodiment can be further modified by defining that said slot opens to a spinner that spreads said salt around via two or more fins.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
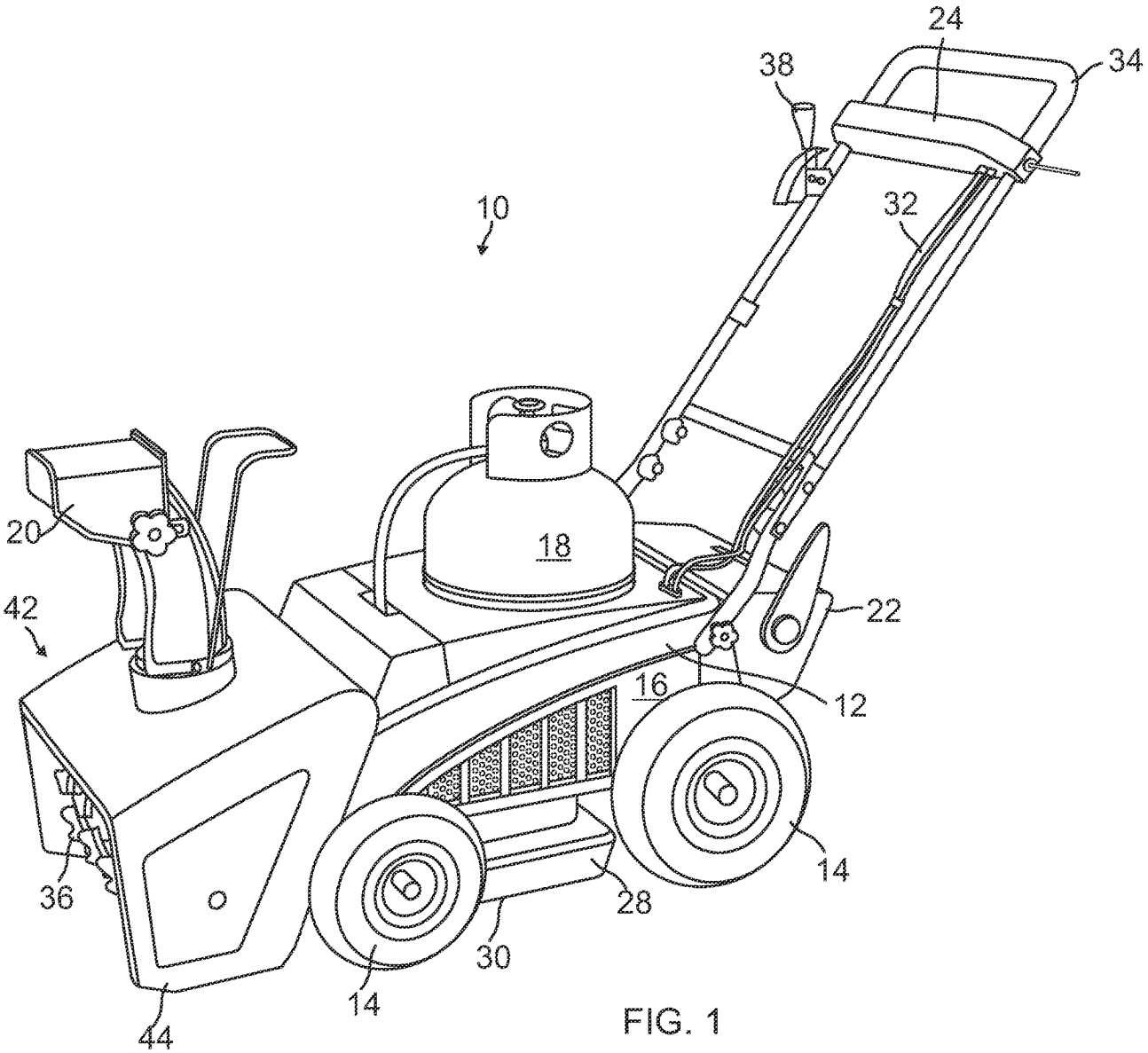
FIG. 1 is a side perspective view of the snow and ice evaporator of the instant invention.
Figure 2:
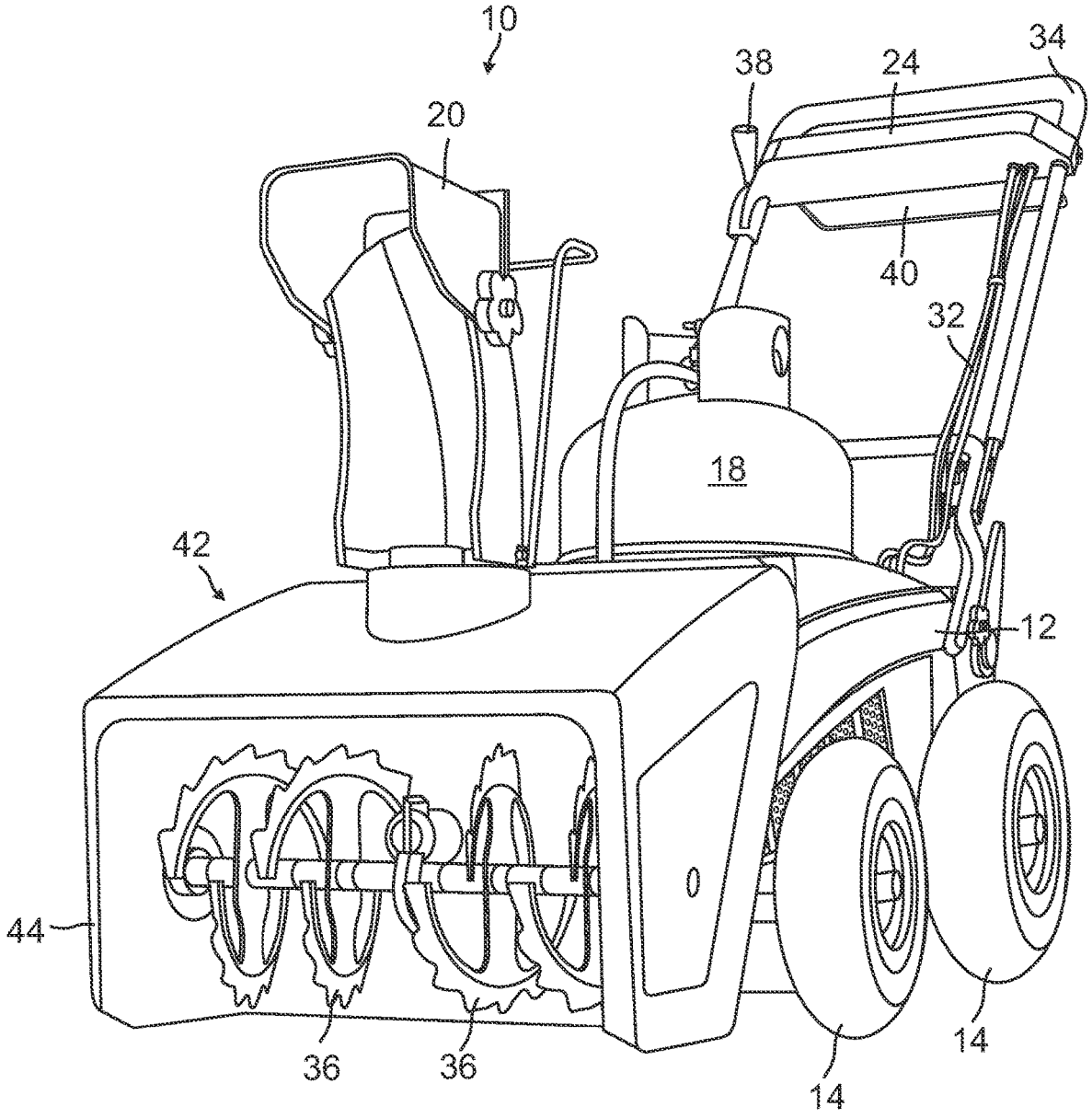
FIG. 2 is a front perspective view of the snow and ice evaporator of the instant invention.
Figure 3:
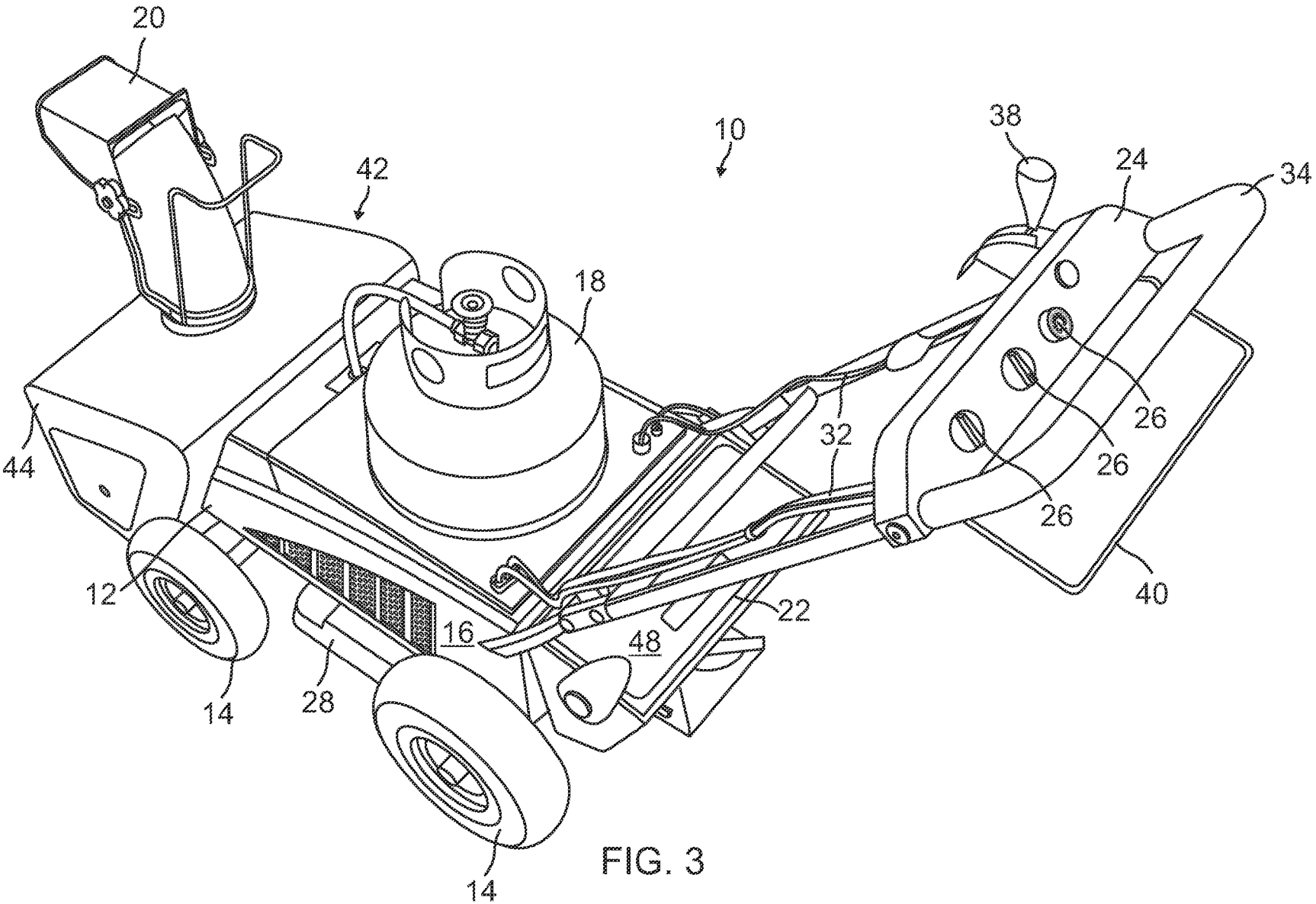
FIG. 3 is a top isometric view of the snow and ice evaporator of the instant invention.
Figure 4:
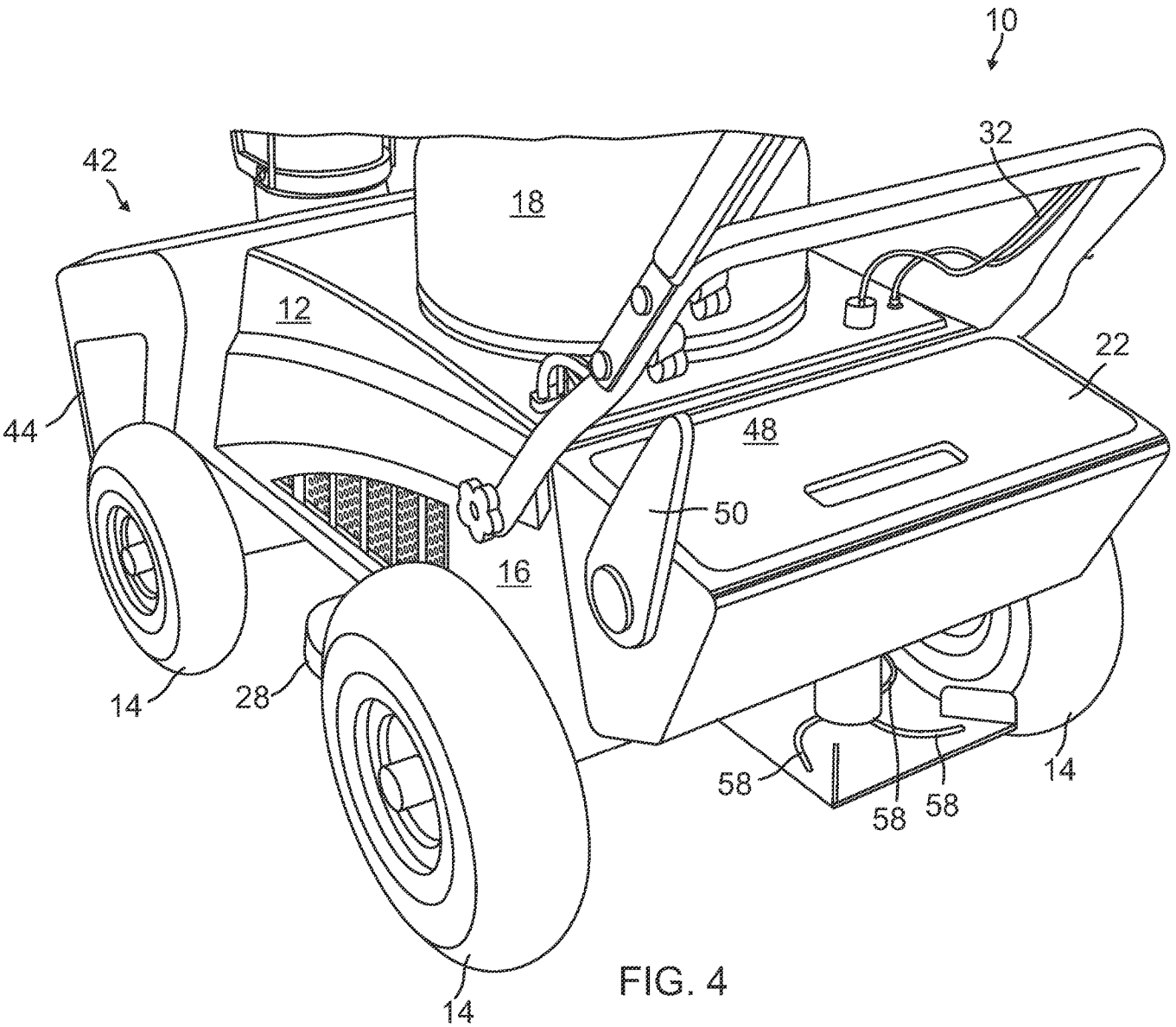
FIG. 4 is a rear perspective view of the bottom portion of the snow and ice evaporator of the instant invention.
Figure 5:
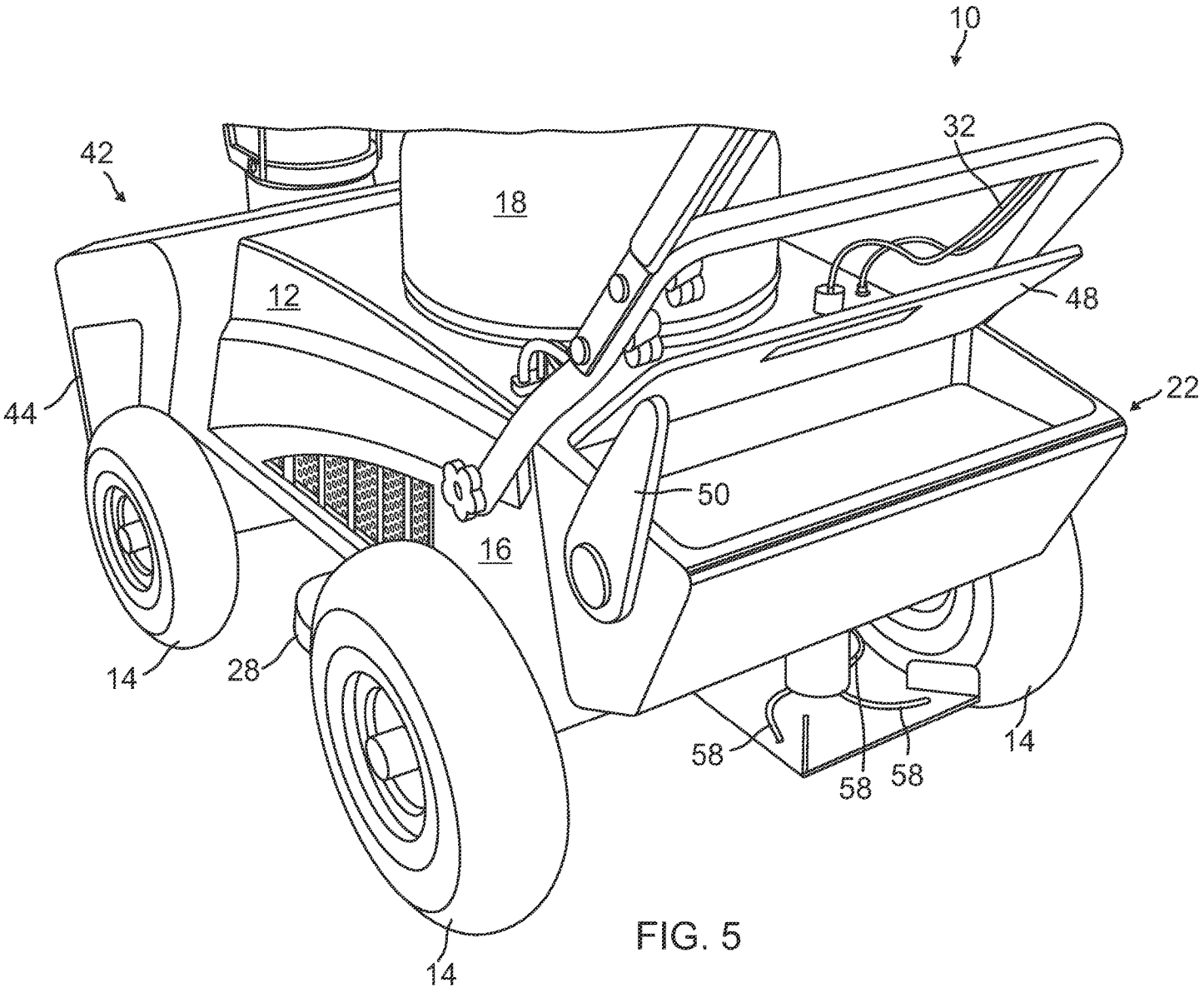
FIG. 5 is the same view as FIG. 4 but with the lid to the salt hopper open.
Figure 6:
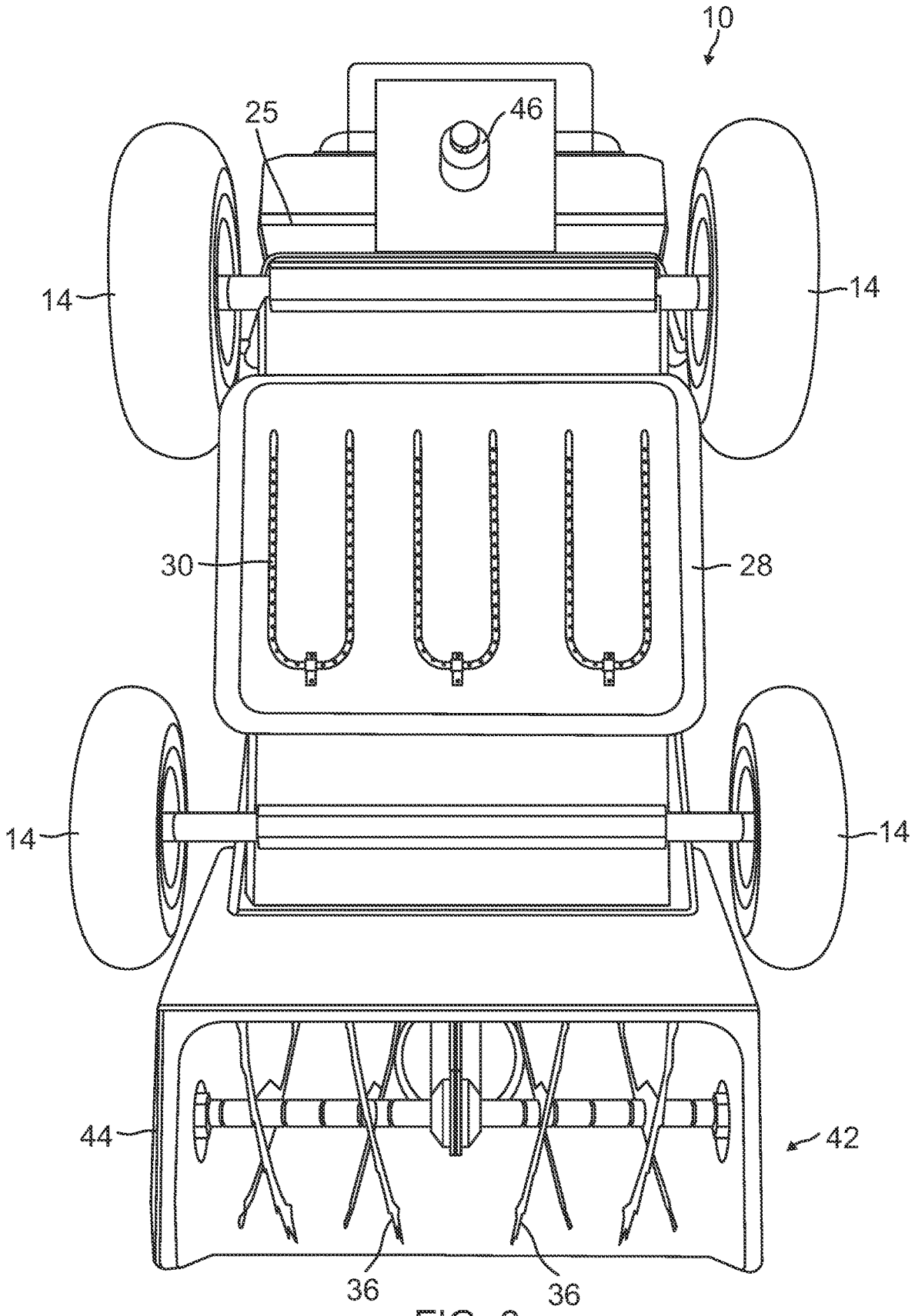
FIG. 6 is a bottom plan view of the snow and ice evaporator of the instant invention.
Figure 7:
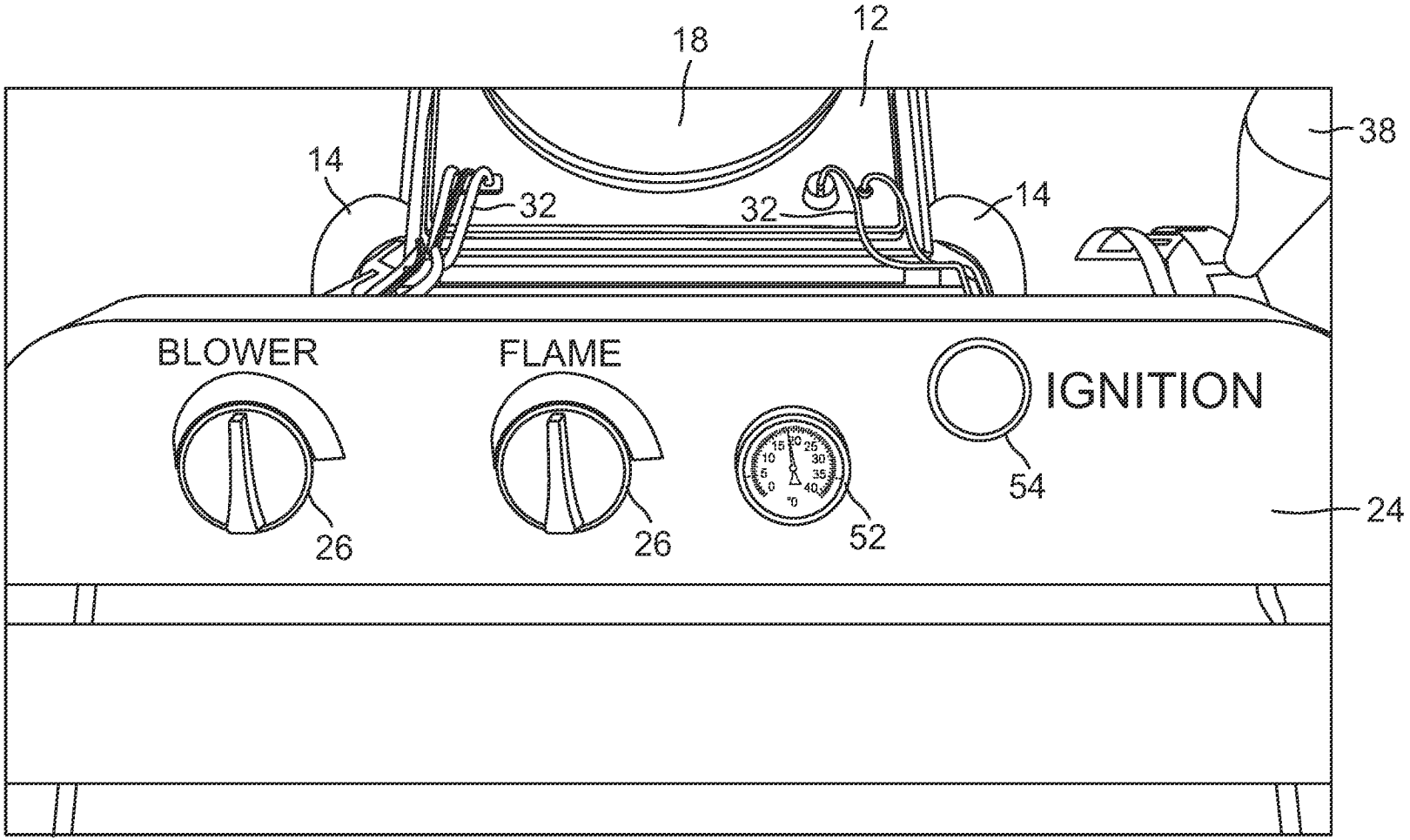
FIG. 7 is a top view of the controller of the snow and ice evaporator of the instant invention.

Turning to the drawings, the preferred embodiment is illustrated and described by reference characters that denote similar elements throughout the several views of the instant invention.

The preferred embodiment of the instant invention provides for a single, untethered device that can be used by an individual to remove snow and ice from the ground. The device 10 resembles a lawn mower in some aspects and a snow blower in other aspects. In combination, the device is capable of removing snow as well as melting ice without sublimating the ice, after which salt can be applied to the surface being cleared to prevent refreezing.

The objective of the device 10 is to blow and/or melt snow, to melt ice without sublimation and to heat the surface being treated to allow some moisture content to steam away. Salt is applied to prevent refreezing, thereby reducing the amount of propane needed to effectively clear the targeted surface.

The front end of the device 10 operates much like a snow blower. The controls hybridize typical snow blowers with controls like a lawn mower, but modified to allow for the salt hopper to be spread to prevent refreezing of the melted ice. The device 10 can be gas or electric powered and propane is used to allow for the heating and melting while the salt hopper is added to prevent refreezing of melted ice.

The device 10 includes a base 12 that includes wheels 14 attached thereto so the device 10 easily rolls. Attached to the base is an extended handle 34. The handle 34 extends upward from the base 12 which includes a controller 24 with an array of control knobs 26, including blower control and flame control. Also on the controller 24 is a thermometer 52 which controls the heat and an ignition switch 54 that controls the entire powering on or off the device 10. A kill switch 40 like those on lawn mowers is included for emergency cut off of power. Wires 32 extend from the controller 24 to the base 12, which has an engine compartment 16 blow. Extending therethrough to the torch array 30 under the base 12 and engine compartment 16 that is close to the ground and protected by a shroud 28. At the rear of the device 10 is the salt hopper 22 which is controlled by the salt hopper control 38 also attached the extended handle 34.

Attached to the front end of the device 10 is the snow blower main body 42 which includes a skid plate 44 and augers 36 like those found in typical snow blowers. Also, a snow blower portion 20 allows for the blowing away of snow after being hit by the augers 36. A propane tank 18 sits atop the base 12 and provides the heat necessary to melt snow and/or ice. The wires 32 extending downward from the extended handle 34 control the snow blower auger 36 speed, the flame/propane volume, the thermometer and the ignition.

The salt hopper 22 includes a bin that holds salt or ice melt. The bin includes a lid 48 that lifts up so that salt can be added. As the device 10 moves forward as it is pushed by the extended handle 34 and rolls along the wheels 14, salt falls through a slot 56 in the bottom of the hopper 22 and is spread along the surface being treated by a spinner 46. The spinner 46 rotates as the salt drops onto it from the bin above it. As the spinner 46 spins, the fins 58 connected thereto help to fling the salt, spreading it across the treated surface. A lever 50 on the side of the bin of the salt hopper 22 opens the slot 56 under the salt hopper 22 to let the salt out to interact with the spinner 46.

To operate, the propane tank 18 is filled with fuel and connected the base 12 of the device 10. The lid 48 to the salt hopper 22 is raised so salt can be added therein. The ignition 54 is turned on and the user grips the handle 34. The user pushes the entire device 10 via the handle 34 along a surface to be treated that the wheels 14 roll along. The user uses the controller 24 to control the snow blower 20 and the flames from the propane tank 18 that come out from under the shroud 28 along an array to melt snow and/or ice. The controller 24 allows for the augers 36 to turn and break up ice and to exit through snow blower 20. As flames hit the surface and melt ice, salt can be dropped on to the treated surface through moving the lever 20 via the salt hopper control knob 38 that opens the slot 56 in the salt hopper 22, allowing salt to exit therethrough where it hits the spinner 46 which spreads the salt on the treated surface through the spinning fins 58.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A snow and ice evaporator comprising:
a base;
wheels attached to said base;
a handle extending upward from said base;
an engine housed in a compartment below said base;
a propane tank compartment on said base;
an array of torches under said base in communication with a propane tank housed in said propane tank compartment;
a snow blower attached to a front of said base, said snow blower further comprising a skid plate, augers and an ejection chute for snow and ice;
a salt hopper attached to a back end of said base, said salt hopper allowing for the expulsion of salt therefrom onto a surface being treated below said salt hopper;
controllers on said extended handle to control said snow blower, said salt hopper and any flames from said propane tank, said controllers being in wired communication with said snow blower, said salt hopper and said array of torches.

2. The snow and ice evaporator as defined in claim 1 wherein said engine is gas operated.

3. The snow and ice evaporator as defined in claim 1 wherein said engine is electrically powered.

4. The snow and ice evaporator as defined in claim 1 wherein said array of torches is covered by a protective shroud.

5. The snow and ice evaporator as defined in claim 1 wherein salt hopper further comprises an open and closeable lid to allow for the placement of salt therein.

6. The snow and ice evaporator as defined in claim 1 wherein said salt hopper further comprises a slot on a bottom of said salt hopper controlled by a lever to allow for the expulsion of salt therefrom.

7. The snow and ice evaporator as defined in claim 6 wherein said slot opens to a spinner that spreads said salt around via two or more fins.

* * * * *